United States Patent [19]

Cates

[11] 4,150,829

[45] Apr. 24, 1979

[54] GAME APPARATUS

[76] Inventor: John A. Cates, 444 Drummond Dr., Raleigh, N.C. 27601

[21] Appl. No.: 795,208

[22] Filed: May 9, 1977

[51] Int. Cl.[2] ..... A63F 3/00

[52] U.S. Cl. ..... 273/265; 273/282; 273/288

[58] Field of Search ..... 273/130 R, 130 AC, 130 D, 273/131 R, 131 AC, 131 AB, 131 B, 131 BA, 139, 241, 265, 287, 282, 288

[56] References Cited

U.S. PATENT DOCUMENTS

| | | | |
|---|---|---|---|
| 2,476,457 | 7/1949 | Schneider | 273/130 D UX |
| 2,801,108 | 7/1957 | Peterson | 273/139 |
| 3,375,009 | 3/1968 | Stubbmann et al. | 273/139 X |
| 3,532,343 | 10/1970 | Eggers | 273/153 R |
| 3,550,943 | 12/1970 | Hatcher | 273/131 AB UX |
| 3,630,525 | 12/1971 | Weisbecker | 273/130 D |
| 3,709,497 | 1/1973 | Barlow | 273/130 R |
| 3,888,487 | 6/1975 | Replogle | 273/130 AC |

FOREIGN PATENT DOCUMENTS

| | | | |
|---|---|---|---|
| 797013 | 6/1958 | United Kingdom | 273/241 |

*Primary Examiner*—Anton O. Oechsle
*Attorney, Agent, or Firm*—Mills & Coats

[57] ABSTRACT

The present invention relates to a game apparatus comprising a game board having at least two playing areas. Each playing area includes a plurality of passageways with an object normally stationed adjacent one end of each passageway. A set of a plurality of various length locking tumblers are provided each player or team of players, and in the case of playing the game of the present invention each locking tumbler is placed in passageways to effectively "lock" each object adjacent a respective passageway. Without knowing the particular placement of the locking tumblers in the passageways about a particular area, a player then selects from a set of a plurality of various length keys and inserts the keys, one at a time, into the passageways with the object being to move a respective locking tumbler to where that tumbler protrudes from its passageway and engages the adjacent object and causes the same to move from a locked position to an unlocked position. The length of the keys and locking tumblers are selected such that the shorter the length of a particular key, the fewer locking tumblers of the locking tumbler set that particular key will unlock. Thus it is the object to unlock as many objects as possible making the most efficient use of the keys of a key set.

15 Claims, 7 Drawing Figures

GAME APPARATUS

The present invention relates to amusement devices and games of skills, and more particularly to a game apparatus that may be played by two or more players and which generally requires logical deduction and memory to be played skillfully.

SUMMARY OF THE INVENTION

Amusement devices and games of skills and chance have long been played and enjoyed by people of all ages. The present invention relates to a game apparatus and game that may be played by two or more players and which generally requires memory, intellect, and logical deduction in order to play the game skillfully and successfully.

The game is referred to herein as "LOCK" and basically comprises a game board having two opposed playing areas or stations, each playing area including a plurality of passageways with a spherical object movably stationed adjacent a terminal end of each passageway and movable therefrom into an adjacent drop cavity formed in the game board. The object of the game entails moving the spherical objects located about a respective playing area into the drop cavities. In playing the game, a locking tumbler from a set of various length locking tumblers is placed in each passageways prior to the start of the game. Without knowing which length locking tumblers are located in each passageway of a player's playing area or side, the player then attempts to unlock each passageway with one key from a set of keys of various lengths. Unlocking is realized when the combined length of the inserted key and the internal locking tumbler is sufficient to cause the locking tumbler to protrude out the terminal end of the respective passageway adjacent the located spherical object so as to cause the spherical object to move into the adjacent drop cavity. One intriguing and interesting aspect of the game arises because the lengths of the keys and the locking tumblers of each set are dimensioned such that certain keys of the key set are only effective to unlock certain locking tumblers of the locking tumbler set. In playing games with the game apparatus of the present invention, scoring can only be achieved by moving a spherical object into an ajacent drop cavity. But because of the varying difficulties of unlocking certain locking tumblers, it is contemplated that "key points" would be awarded for each score, and the "key points" awarded for each score would preferably increase with the level of difficulty for achieving an unlock state with a certain key of the key set.

It is, therefore, an object of the present invention to provide a game apparatus and game that is interesting and challenging and which requires the utilization of memory, intellect and logical deduction.

Another object of the present invention is to provide a game apparatus and game that can be played and enjoyed by individuals of a wide age group, including children, adults, and young adults.

A further object of the present invention is to provide a game apparatus having a game board and associated playing components that is simple in construction and relatively inexpensive to manufacture.

Other objects and advantages of the present invention will become apparent from a study of the following description and the accompanying drawings which are merely illustrative of the present invention.

THE GAME APPARATUS

Figure 1:
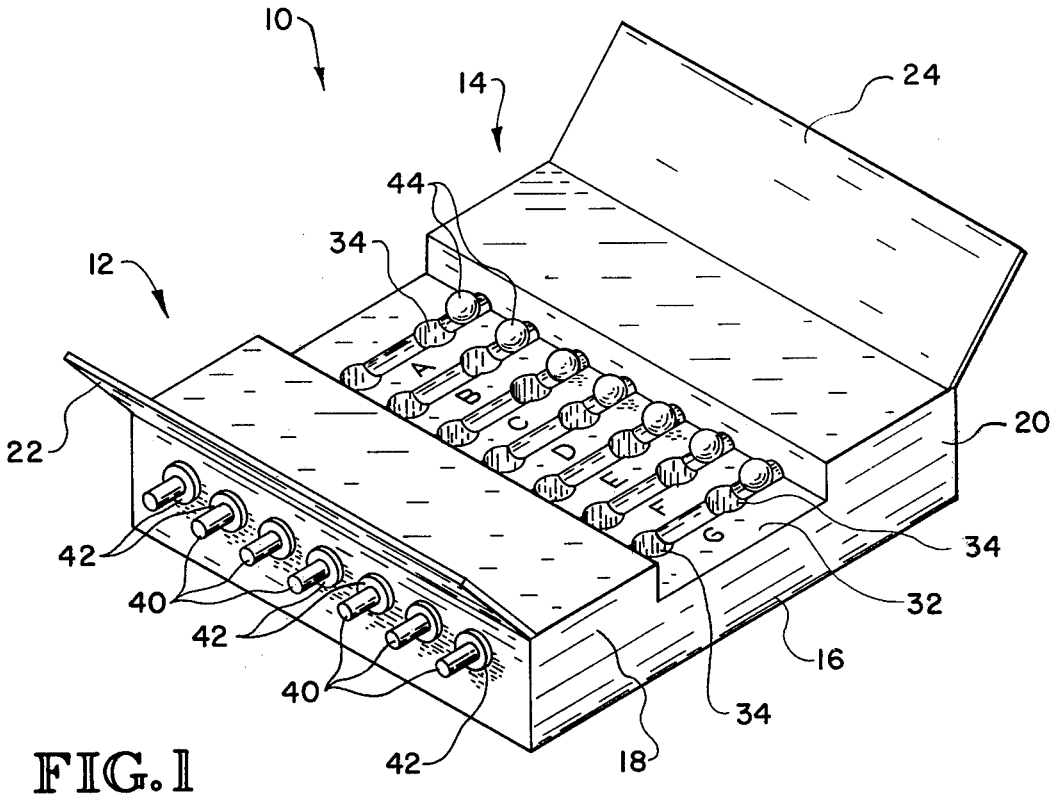
FIG. 1 is a perspective view of the game apparatus of the present invention.
Figure 2:
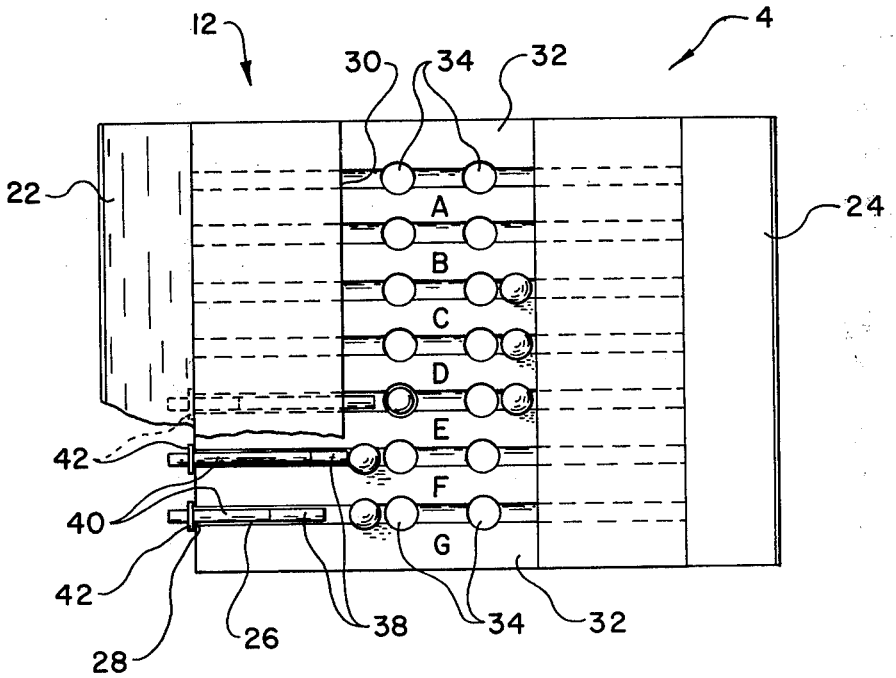
FIG. 2 is a top plan view of the game apparatus of the present invention with a portion thereof being broken away to better illustrate an internal portion of the game apparatus.

With further reference to the drawings, particularly FIG. 1, the game apparatus of the present invention is shown therein and comprises a game board or structure, indicated generally by the numeral 10. Before dealing with the particulars of a game that may be played by use of the game apparatus and its various playing components, the discussion will first deal with the structure of the game apparatus and its various playing components.

In this regard, game board 10, constructed of wood, plastic, or any other suitable material, includes two playing areas, indicated generally by the numerals 12 and 14, respectively, and wherein the particular playing ares are opposingly disposed such that one or more players during the course of the game will be stationed on one side of the game board 10 while the other opposing player or players will be stationed on the other side. Game board 10 comprises a base 16 having two playing side areas 18 and 20 with a shield or blinder 22 and 24 secured to the outer upper edge of respective playing sides 18 and 20 and extending angularly therefrom.

Extending through the game board 10 are a plurality of passageways or playing slots 26 that extend longitudinally through the elevated side areas 18 and 20 and are of a generally cylindrical bore. In the particular embodiment illustrated in the drawings, there are seven passageways formed in each side 18 and 20 of the game board 10, each passageway having an inlet end 28 beginning about the outer end or edge of the game board and extending through the elevated side to where an outlet end 30 is defined. For purposes of reference, the passageways or playing slots are identified by references A, B, C, D, E, F and G about an intermediate board area 32 that is disposed about a level just below the top of the sides 18 and 20.

As seen in the drawings, the passageways 26 of each side area are generally aligned and in fact as illustrated in the drawings the passageways or playing slots continue about the intermediate board area 32 in the form of a generally semi-cylindrical indention.

Transversely aligned across the intermediate board area 32 adjaceng both side areas 12 and 14 are a set of drop cavities 34, each drop cavity being disposed adjacent and in alignment with a terminal or outlet end 30 of the respective passageways 26.

Figure 4:
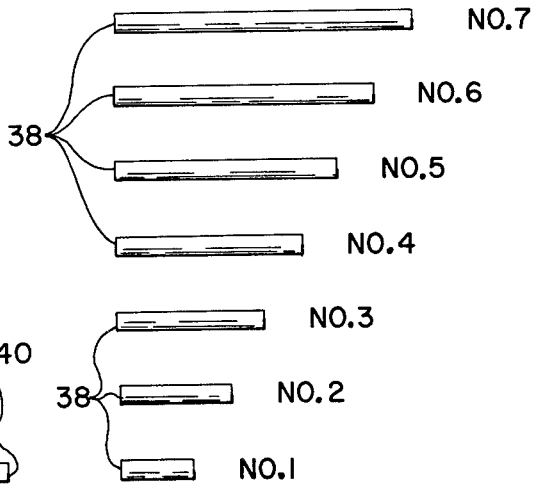
FIG. 4 illustrates a set of locking tumblers that also form a part of a game apparatus of the present invention.

The game apparatus of the present invention is provided with at least two sets of locking tumblers, and in the case of a preferred embodiment as disclosed herein, each locking tumbler set includes a plurality of seven locking tumblers, all of a varying length and each referred to by the numeral 38. As illustrated in FIG. 4, the locking tumblers 38 illustrated therein are each designated by a number and in the case of the seven locking tumblers shown therein the locking tumblers are denoted by Nos. 1 through 7. It is seen that the length of the locking tumblers 38 progressively increase in length from locking tumblers No. 1 to locking tumbler No. 2 and so on through locking tumbler No. 7.

Figure 3:
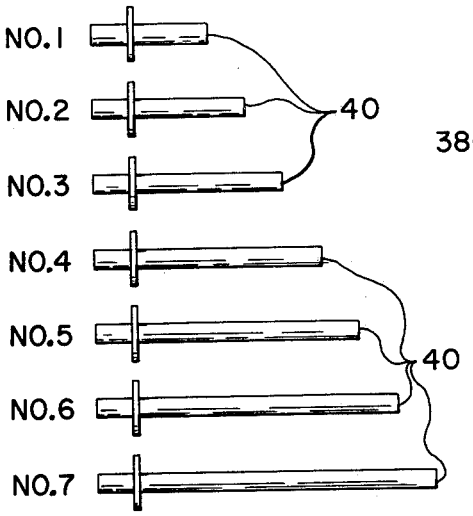
FIG. 3 illustrates a set of keys that form a part of the game apparatus of the present invention.

Shown in FIG. 3 adjacent the set of locking tumblers is a set of keys. The set of keys includes a plurality of seven keys, each being referred to by the numeral 40 and since each is of a different length they are, as with the locking tumblers, denoted by a number. Key No. 1 is the shorter of the keys of the key set and each successive numbered key thereafter is slightly longer than the preceding numbered key. The game apparatus of the present invention would include at least two sets of keys and two sets of locking tumblers, one set for each player or team of players.

From subsequent portions of this disclosure, the relationship of the various length keys 40 to the various length locking tumblers 38 will be explained in greater detail, and especially how they interplay during the course of a game played with the game apparatus of the present invention.

Figure 5:
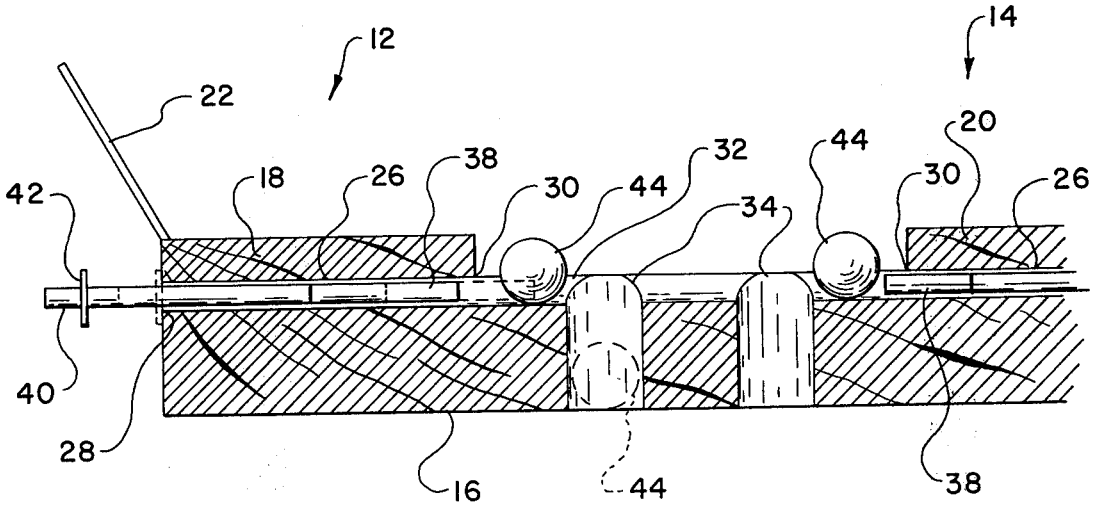
FIG. 5 is a fragmentary side sectional view of the game apparatus and game board of the present invention illustrating a key engaging a locking tumbler within a passageway to successfully move an object from an initial locked position to an unlocked or scoring position within a drop cavity.

The game apparatus of the present invention is also provided with a plurality of objects or men, referred to by the numeral 44. Each object is, in the case of the preferred embodiment disclosed, a spherical object and can be a small ball object or a marble. During the course of the game, a set of spherical objects or marbles 44 are transversely aligned with the terminal end 30 of respective passageways 26 and are generally disposed between that terminal end and the adjacent drop cavity 34, as illustrated in FIG. 5.

THE GAME "LOCK"

With the game apparatus of the present invention, a game can be played by two or more people and can appropriately be termed "LOCK". When played by two players, one version of the game "LOCK" can be played by issuing to each player a set of locking tumblers and a set of keys corresponding to those illustrated in FIGS. 3 and 4. First, each player places each of the series of seven locking tumblers 38 into various passageways 26 about the opposing player's side of the playing board. It is noted that there are seven passageways 26 on each side of the board and seven locking tumblers 38. Therefore, each passageway will have a respective locking tumbler inserted therein. The locking tumblers 38 are inserted in random fashion and during the course of inserting the locking tumblers the blinders or shields 22 and 24 keep an opposing player or team from seeing which locking tumblers are placed in which passageways. It should be pointed out that because of the various length of the locking tumblers 38, that each should be inserted such that the outer end stops or terminates with the outer side of the playing board or the inlet end 28 of the respective passageways 26.

After each player has inserted the locking tumblers into a side of a playing board, the players should note or at least remember which locking tumbler is placed in which passageway. Then, the game board 10 is rotated 180 degrees to where the locking tumblers placed in the game board by each opposing player now directly faces the other player.

The game is begun by determining who moves first and this can be done by any number of ways such as drawing from a set of keys 40 to see which player or team draws a longer or shorter key. After this has been determined, the game is ready to be played and it is the object of each player to insert respective keys 40 of his or her key set, shown in FIG. 3, into respective passageways 26 on his side of the game board in an effort to move an internally contained locking tumbler from an initial locked position to an unlocked position which corresponds to causing the object 44 adjacent the terminal end of that respective passageway to move and drop into an adjacent drop cavity 34. Of importance is the fact that the different locking tumblers, i.e., locking tumblers Nos. 1 through 7, are each progressively longer than a preceding locking tumbler number, and because of the various length of the keys 40 of the key set shown in FIG. 3, not all keys of the key set will be effective to unlock all of the locking tumblers.

In the case of the sets of keys and locking tumblers of FIGS. 3 and 4, the following table sets forth which locking tumbler each key will effectively unlock and suggest the awarding of certain "key points" for unlocking particular locking tumblers with a certain key.

| KEY | LOCKING TUMBLER OR TUMBLERS WHICH MAY BE UNLOCKED BY A PARTICULAR KEY | SUGGESTED KEY POINTS AWARDED |
|---|---|---|
| No. 1 | No. 7 | 7 |
| No. 2 | No. 6, No. 7 | 6 |
| No. 3 | No. 5, No. 6, No. 7 | 5 |
| No. 4 | No. 4, No. 5, No. 6, No. 7 | 4 |
| No. 5 | No. 3, No. 4, No. 5, No. 6, No. 7 | 3 |
| No. 6 | No. 2, No. 3, No. 4, No. 5, No. 6, No.7 | 2 |
| No. 7 | No. 1, No. 2, No. 3 No. 4, No. 5, No. 6, No. 7 | |

Thus, it is appreciated that in order to effectively unlock a locking tumbler 38, the combined length of an inserted key and the locking tumbler of a particular passageway must be at least a certain length. In the case of the embodiment illustrated above, it is seen that key No. 4 of the key set will not unlock locking tumbler No. 2 of the locking tumbler set. But, it is seen that key No. 4 will unlock locking tumblers Nos. 4, 5, 6, and 7.

It is also appreciated from the above table that the shorter the key, the more difficult it becomes to unlock a locking tumbler in a passageway on a pure random basis. Accordingly, as the difficulty increases, the "key points" awarded likewise increase.

In inserting a key into a passageway 26, the key should only be inserted a depth to where the object 44 drops into the drop cavity 34 or until the stop ring 42 of the key engages the edge of the game board. This will prohibit the opponent from knowing exactly what key has been inserted in a particular passageway 26. In a contemplated version of the game "lock", the player inserting a particular key should be appraised of which locking tumbler is in that particular slot when in fact an unlocked situation results from playing a particular key. This information can be furnished by the opponent, or in the alternative indicia may be placed on each key such that the depth of insertion will automatically indicate what tumbler has been unlocked.

Figure 6:
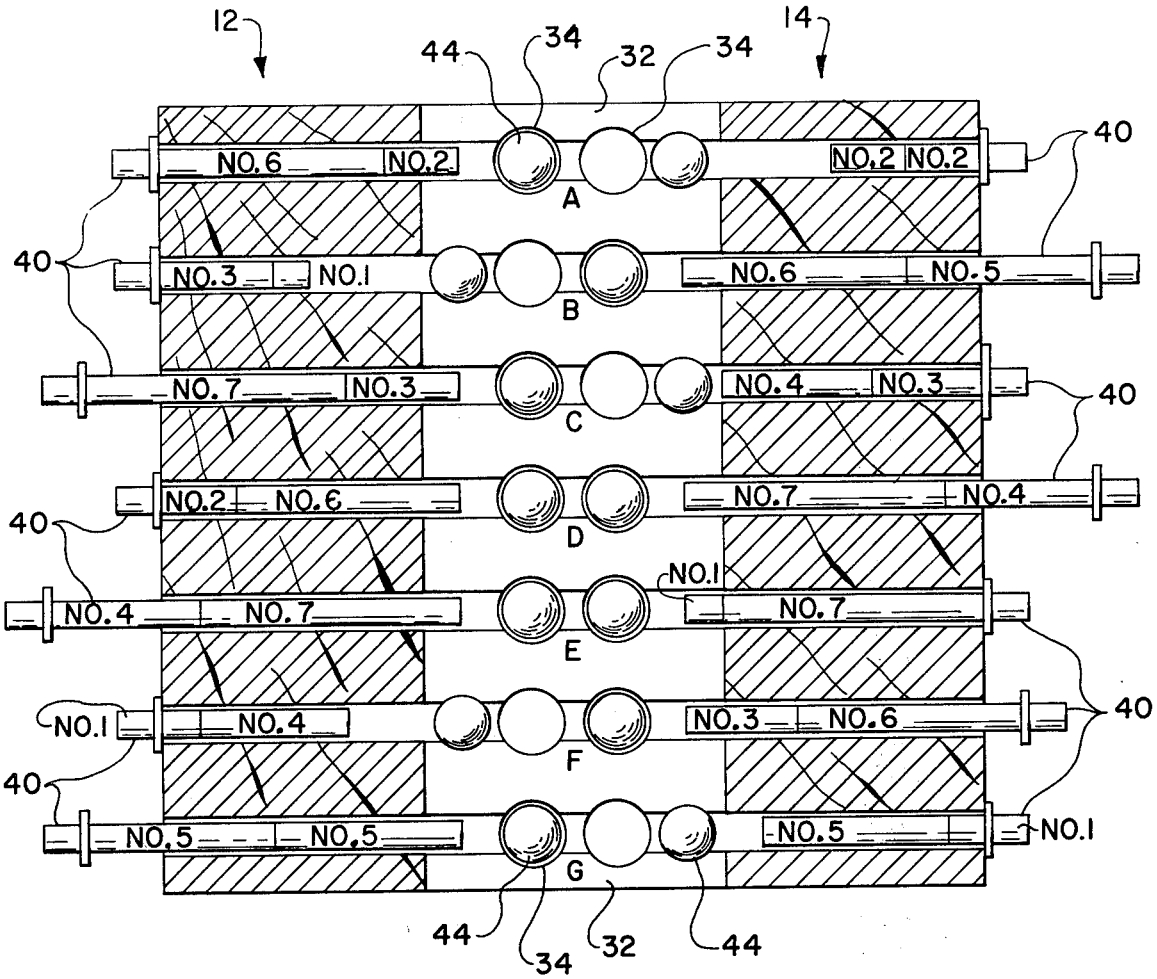
FIG. 6 is a top plan view of the game apparatus of the present invention with a top portion thereof being removed to illustrate the position of the objects, locking tumblers, and keys after a game has been played.

To better appreciate the game "LOCK" and a contemplated method of scoring, reference is made to FIG. 6 that illustrates the game apparatus of the present invention and the playing components thereof after a game has been played. Note that the player playing side 12 has unlocked the locking tumblers 38 in passageways or playing slots A, C, D, E and G of the game board 10. The opposing player, playing side 14, has unlocked locking tumblers 38 in playing slots B, D, E and F. In scoring, one point (a base point) is awarded a player for each playing slot where a locking tumbler is unlocked and the associated object assumes a position in an adjacent drop cavity, and where the opposing player's object for that same slot remains in a locked position. Where in one playing slot, the objects 44 of both players remain locked or unlocked, a tie is declared and no points are awarded. In accordance with this, the player's playing side 12 is awarded three base points based on the fact that in playing slots A, C and G the object 44 on his side of the game board has been unlocked while the opposing player's object in each of these slots remains locked. Likewise, the player playing side 12 is awarded two base points due to the unlocked situation that exists in playing slots B and F, because in each of these slots that player's object 44 has been unlocked while the opposing objects 44 of the same slots remain unlocked.

With the base score just referred to, i.e., three points for the player playing side 12 and two points for the player playing side 14, there is added "key points" for each slot where a base point has been scored. In accordance with the suggested scoring table outlined hereinbefore, with respect to the player playing side 12, it is seen that the unlocked result of slot A was achieved with a No. 6 key and consequently two "key points" is awarded for this, one "key point" is awarded for the No. 7 key utilized in slots C and three "key points" are awarded for the No. 5 key utilized in slot G. Therefore, the player playing side 12 is awarded a total of six "key points" that are combined with the three base points and which yield a total of nine points.

The player playing side 14 achieved an unlocked situation in slots B and F. In slot B a No. 5 key was utilized and three "key points" are awarded for this, and in slot F a No. 6 key was utilized and two "key points" are awarded for this. This gives the player playing side 14 a total of five "key points" which combine with the two base points give a total of seven points. Therefore, in this suggested or contemplated method of scoring, the player playing side 12 wins the game by a score of nine to seven. It should be noted that in this contemplated or suggested method of scoring, that no "key points" are awarded in slots that result in a tie which, as noted above, results when both players objects 44 of a particular slot are unlocked or remain locked.

Figure 7:
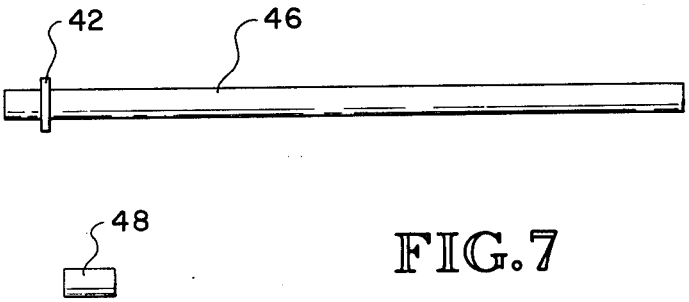
FIG. 7 illustrates a master key and a dead bolt locking tumbler that comprise alternate game components for the game apparatus of the present invention.

With reference to FIG. 7, an alternate master key 46 and an alternate dead bolt locking tumbler 48 are shown. These two playing pieces may be used in an alternate game that may be played with the game apparatus of the present invention. In this case, the master key 46 will unlock all of the aforementioned locking tumblers 38 of the set shown in FIG. 4. In addition, it is seen that when using the master key 46 it is of sufficient length that when inserted within a respective passageway 26 that its remote end will project to the opposite side of the game board 10 and in accordance with proposed rules is effective to block and completely prohibit the opposing player from unlocking the object 44 on his side of the playing board in that same playing slot.

With respect to the dead bolt locking tumbler 48, it is of a particular length that is so short that not any one of the keys of the set shown in FIG. 3 would effectively unlock such when in a passageway 26. In an alternate game format, it is contemplated that each player would be issued both a master key 46 and a dead bolt 48, but it is suggested that each player be allowed to use only one of the two. Because the dead bolt must be inserted prior to the actual playing of the keys, it follows that a decision as to which is to be used must be made before the game proceeds. It is suggested that no "key points" be awarded for the use of a master key 46, but only a base point awarded for unlocking an object in a particular playing slot. In playing the game in this alternate game format, the master key may be substituted for any other key in the key set. Also, the opponent should not be aware of whether or not a player has used a dead bolt or master key 46 until the fact is actually revealed during the course of the game.

The game apparatus of the present invention can be played by more than two players by placing two or more game boards together. For example, two game board corresponding to that shown in the drawings can be placed side by side to accommodate four players, two on each side. In such case the players alternate in making the plays and the score is added up in the same manner as suggested above and a team score is reached by adding the individual scores of the players for each team.

From the foregoing specification, it is clear that the game board apparatus of the present invention presents a game board and game that is intriguing and fascinating. The particular relationship of the various length keys 40 and locking tumblers 38 and the aspect of awarding "key points" gives the game a character that rewards intelligence, memory and deductive logic. It should be noted, that although a suggested scoring scheme has been outlined above, that the game apparatus and the components thereof of the present invention can be utilized to play games such as the game "LOCK" and that the rules of scoring can be altered as desired from that suggested above.

The present invention, of course, may be carried out in other specific ways than those herein set forth without departing from the spirit and essential characteristics of the invention. The present embodiments are, therefore, to be considered in all respects as illustrative and not restrictive, and all changes coming within the meaning and equivalency range are intended to be embraced herein.

What is claimed is:

1. A game device comprising: a game board having at least two distinct and separate playing areas with each playing area including a plurality of passageways; at least two sets of locking tumblers with each set having a plurality of various length locking tumblers, each locking tumbler being adapted to be inserted within a respective passageway and each being of a length less than the length of said passageways and movable therein between an initial locked position and an unlocked position; a plurality of objects normally occupying a locked position outside of and adjacent one end of respective passageways and movable from said locked position to an unlocked position still outside of said passageways; at least two sets of key members with each set including a plurality of various length key members cooperative with a respective tumbler of each tumbler set for engaging respective locking tumblers and causing the same to be moved from said initial locked position to in some cases the unlocked position, each key member adapted to be inserted within a respective passageway behind a respective locking tumbler and to move said locking tumbler from its initial locked position toward said unlocked position, and wherein where the combined length of a respective key member and tumbler in a respective passageway is equal to or greater than a predetermined length said tumbler will be moved to said unlocked position and will accordingly engage a respective object and move the same to its unlocked position; and wherein one or more of the various key members comprising a key set is of sufficient length to cooperate with less than the total number of locking tumblers of a locking tumbler set to unlock respective objects such that certain key members may or may not be of sufficient length to cause a respective locking tumbler to move to said unlocked position and to engage an object disposed adjacent a passageway and causes the object to move from the locked position to an unlocked position.

2. The game apparatus of claim 1 wherein said objects include a plurality of spherical objects and wherein said game board includes a cavity formed adjacent the area occupied by each of said spherical objects when in the locked position and wherein in moving from said locked position to said unlocked position a spherical object falls into the adjacent cavity formed within said game board.

3. The game device of claim 2 wherein said spherical objects are marbles.

4. The game device of claim 2 wherein said passageways extend from opposite sides of said game board with each passageway having an inlet end disposed about one outer side of said game board and an inner end that terminates intermediately about the game board adjacent the area occupied by respective spherical objects when in said locked position; and wherein said cavity formed adjacent each spherical object is formed about an intermediate area occupied by said spherical objects when in the locked position; and wherein same game board is provided with a pair of shields about each side thereof for generally preventing one player from seeing which locking tumblers are placed in particular passageways prior to the beginning of the game.

5. The game apparatus of claim 4 wherein the passageways formed about a playing area on one side of said game board are aligned with the passageways formed about the other playing area on the other side of said game board.

6. The game apparatus of claim 4 wherein said passageways are of a generally cylindrical bore and wherein said locking tumblers and said key members are of a cylindrical shape of slightly less diameter than the bore of said passageways such that each may be easily inserted therethrough.

7. A game device adapted to be played by two or more players wherein the object is to unlock as many men or objects by the most efficient use of unlocking keys, said game device comprising: a game board having at least two distinct and separate playing areas with each playing area including a plurality of elongated passageways; a plurality of objects normally assuming a locked position about each playing area outside of and adjacent one end of said passageways and movable therefrom to an unlocked position still outside of said passageways; at least two sets of locking tumblers with each set including a plurality of various length locking tumblers with each locking tumbler adapted to be inserted into a respective passageway and wherein the initial location of particular locking tumblers about a respective player's playing area is not disclosed to that player, each locking tumbler normally assuming a locked position in a passageway and movable therefrom to an unlocked position wherein in moving from said locked position to said unlocked position each tumbler is operative to engage an object disposed adjacent one end of that passageway and to move said object to said unlocked position; and two sets of keys with each set including a plurality of various length keys each insertable within a respective passageway and cooperable in certain instances to move a locking tumbler in that passageway to an unlocked position for causing said object aligned with said passageway to be moved to said unlocked position, said plurality of keys and locking tumblers being of different lengths such that at least one key of each key set is ineffective to move at least one locking tumbler of a locking tumbler set to an unlocked position for unlocking a respective object but wherein that same key is at least effective to unlock at least one other locking tumbler of the locking tumbler set.

8. The game device of claim 7 wherein said plurality of keys of each key set includes a group of individual keys wherein except for the shortest key the individual keys comprising a set are each progressively longer than another key of the set; and wherein said plurality of locking tumblers of a set includes a series of locking tumblers wherein except for the shortest locking tumbler the individual locking tumblers comprising the set are each progressively longer than another locking tumbler of the set.

9. The game device of claim 8 wherein the length of the keys and locking tumblers of each set are such that if the keys were played in a pure random manner the probability of any particular key of a set moving a particular locking tumbler of a set to the unlocked position would decrease as the length of the particular keys decrease, that is the shorter key of the set would unlock less locking tumblers of the locking tumbler set than a longer key.

10. The game device of claim 9 wherein said objects comprise a series of marbles and wherein the game board is provided with a series of cavities formed therein for receiving the marbles when moved from a locked position to an unlocked position; and wherein said passageways are of a generally elongated cylindrical bore and wherein said keys and locking tumblers are generally cylindrically shaped.

11. The game device of claim 9 wherein said playing areas of said game board are disposed opposite each other in face to face relationship, and wherein the passageways are generally horizontally aligned about each side of said game board and include an outer inlet end and an inner terminal end; and wherein said plurality of objects include a plurality of generally spherical objects and wherein each spherical object generally assumes a locked position adjacent an inner terminal end of a respective passageway; and wherein said game board is provided with a cavity disposed adjacent the normally locked position of each of said spherical objects for receiving the same when they are moved from the locked position to an unlocked position.

12. The game device of claim 1 wherein to move each locking tumbler to said locked position requires that the combined length of a respective key member and a respective locking tumbler be at least said predetermined length, and wherein in each key member and locking tumbler set there is at least one key member and one locking tumbler whose combined length is equal to said predetermined length.

13. The game device of claim 12 wherein substantial all of the key members and the tumblers of respective sets are of various lengths, and wherein substantially all of said key members are of sufficient length such that when combined with a particular one of the respective tumblers, the combined length is equal to said predetermined length sufficient to move a respective tumbler from said locked position to said unlocked position.

14. The game apparatus of claim 1 wherein each key member is provided with stop means for engaging said game board and limiting the effective length of each key member that extends into the respective passageways.

15. The game apparatus of claim 7 wherein each playing area of said game board is separate, distinct and apart from the other playing area so as to define a game board having at least two separate playing areas with each separate playing area being exclusively reserved for one player or a team of players.

* * * * *